US009157652B2

(12) United States Patent
Chamness

(10) Patent No.: US 9,157,652 B2
(45) Date of Patent: Oct. 13, 2015

(54) VENT COVER WITH BIASED DOOR

(76) Inventor: Ronald Hugh Chamness, Spring Branch, TX (US)

( * ) Notice: Subject to any disclaimer, the term of this patent is extended or adjusted under 35 U.S.C. 154(b) by 541 days.

(21) Appl. No.: 13/598,823

(22) Filed: Aug. 30, 2012

(65) Prior Publication Data

US 2014/0065944 A1 Mar. 6, 2014

(51) Int. Cl.

| | |
|---|---|
| ***F24F 7/00*** | (2006.01) |
| ***F24F 13/06*** | (2006.01) |
| ***F24F 13/08*** | (2006.01) |
| ***F24F 11/047*** | (2006.01) |

(52) U.S. Cl.
CPC ..... *F24F 11/047* (2013.01)

(58) Field of Classification Search
CPC ..... F24F 11/047
USPC ..... 454/249, 275, 269, 367
See application file for complete search history.

(56) References Cited

U.S. PATENT DOCUMENTS

| | | | | |
|---|---|---|---|---|
| 2,218,348 | A | 10/1940 | Boyer | |
| 2,334,789 | A | 11/1943 | Olson | |
| 4,047,328 | A | 9/1977 | Kehl et al. | |
| 4,151,789 | A | 5/1979 | Grobard | |
| 4,457,215 | A | 7/1984 | Vogt | |
| 4,667,581 | A * | 5/1987 | Hovland | 454/260 |
| 4,850,265 | A | 7/1989 | Raisanen | |
| 5,167,578 | A | 12/1992 | Legault | |
| 5,195,927 | A * | 3/1993 | Raisanen | 454/271 |
| 5,383,816 | A * | 1/1995 | Marcello et al. | 454/359 |
| 5,498,204 | A | 3/1996 | Anderson et al. | |
| 5,567,114 | A * | 10/1996 | Wallace | 415/146 |
| 5,692,955 | A | 12/1997 | Meyer | |
| 5,711,091 | A | 1/1998 | Bos | |
| 5,722,181 | A * | 3/1998 | Meyer | 34/235 |
| 5,916,023 | A * | 6/1999 | Meyer | 454/359 |
| 5,921,862 | A * | 7/1999 | Ucciardi | 454/353 |
| 5,980,381 | A | 11/1999 | McCormick | |
| 6,005,770 | A * | 12/1999 | Schmitt | 361/695 |
| 6,149,516 | A * | 11/2000 | Mantyla | 454/359 |
| 6,183,359 | B1 | 2/2001 | Klein et al. | |
| 6,437,457 | B2 | 8/2002 | Roskey | |
| 6,533,656 | B2 * | 3/2003 | Hertel | 454/259 |
| 6,685,557 | B1 | 2/2004 | Hoffe | |
| 7,980,266 | B2 * | 7/2011 | Niedermair | 137/516.17 |
| 2005/0202778 | A1 * | 9/2005 | Stravitz | 454/353 |
| 2008/0233861 | A1 | 9/2008 | Jenkins et al. | |
| 2009/0023379 | A1 * | 1/2009 | Bredahl et al. | 454/267 |
| 2009/0280737 | A1 * | 11/2009 | Jacak et al. | 454/358 |
| 2010/0062704 | A1 | 3/2010 | Markovich | |

FOREIGN PATENT DOCUMENTS

| | | |
|---|---|---|
| EP | 2175207 | 4/2010 |
| JP | 2006194455 | 7/2006 |

* cited by examiner

*Primary Examiner* — Steven B McAllister
*Assistant Examiner* — Jonathan Cotov
(74) *Attorney, Agent, or Firm* — Taylor English Duma LLP

(57) ABSTRACT

A vent cover includes a body having an inner portion and a outer portion, a vent exhaust hole defined in the body through the inner portion and the outer portion, an enclosure defined between the inner portion and the outer portion; and a door movably coupled to the body, the door including a biasing portion and a door portion, the door moveable between a first position and a second position, the door in the first position at least partially covering the vent exhaust hole, the second position having a clearance between the door portion and the vent exhaust hole, the biasing portion enclosed within the enclosure of the body and including a biasing element biasing the door to the first position.

17 Claims, 10 Drawing Sheets

VENT COVER WITH BIASED DOOR

FIELD

This disclosure relates to venting. More specifically, this disclosure relates to vent covers.

BACKGROUND

It is occasionally desirable to remove air from the interior of a building to the exterior of the building through a vent. In many cases, it is also desirable that air from the exterior of the building be prevented from entering the building through the same vent when air is not being removed from the interior of the building through the vent. It may also be desirable to prevent animals or debris from entering the building through the vent. One way of preventing air, animals, or debris from entering a building through a vent is through a vent cover. When air is being removed from the building, the vent cover is open, and when air is not being removed from the building, the vent cover is closed.

SUMMARY

Disclosed is a vent cover including a body having an inner portion and a outer portion, a vent exhaust hole defined in the body through the inner portion and the outer portion, an enclosure defined between the inner portion and the outer portion; and a door movably coupled to the body, the door including a biasing portion and a door portion, the door moveable between a first position and a second position, the door in the first position at least partially covering the vent exhaust hole, the second position having a clearance between the door portion and the vent exhaust hole, the biasing portion enclosed within the enclosure of the body and including a biasing element biasing the door to the first position.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Figure 1:
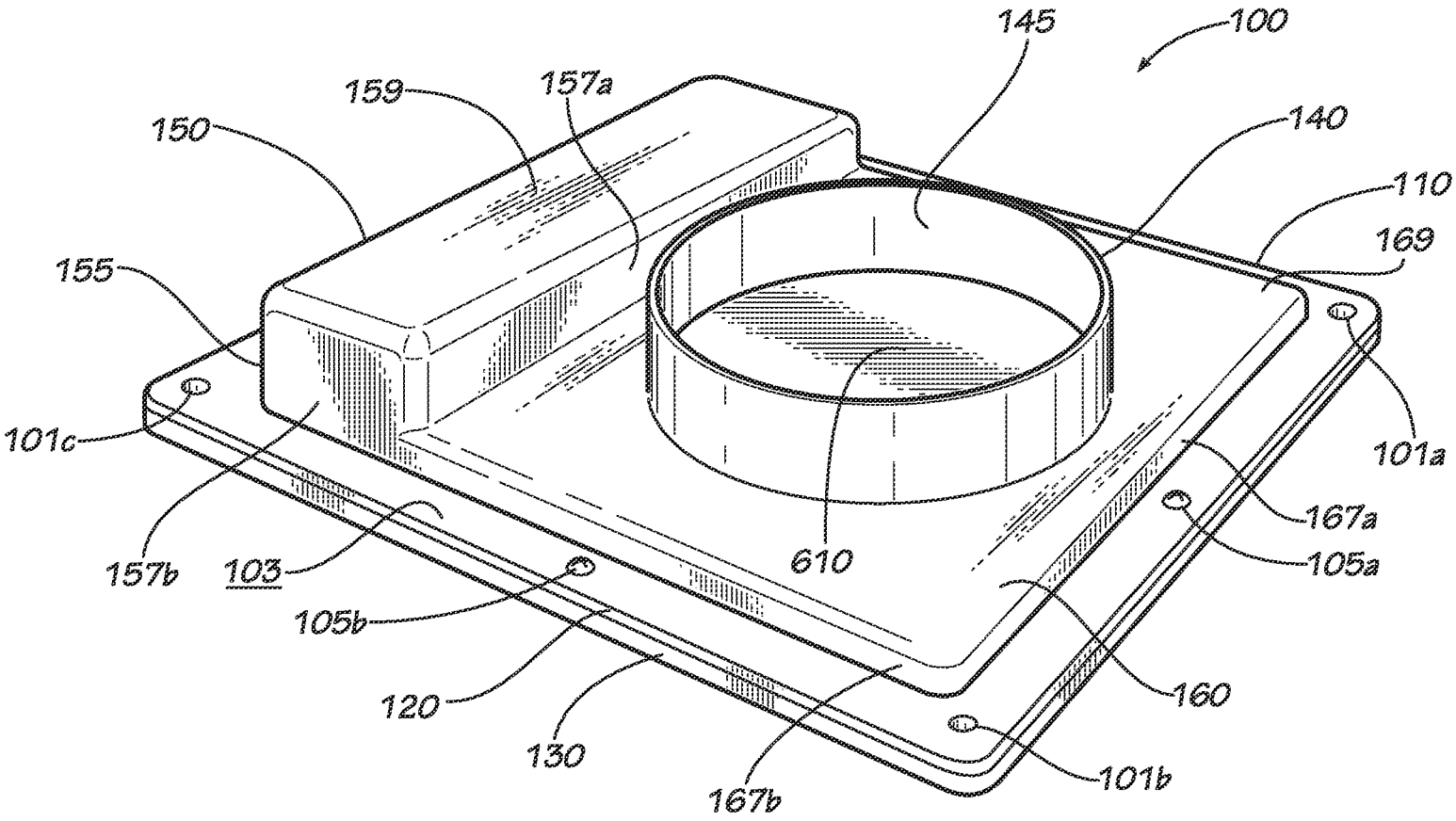
FIG. 1 is a perspective view of a vent cover in accord with one embodiment of the current disclosure.

Disclosed is a vent cover and associated methods, systems, devices, and various apparatus. The vent cover includes a body with an inner portion and an outer portion and a door with a biasing element. The vent cover is adapted for installation on the exterior of a building. It would be understood by one of skill in the art that the disclosed vent cover is described in but a few exemplary embodiments among many. No particular terminology or description should be considered limiting on the disclosure or the scope of any claims issuing therefrom.

One embodiment of a vent cover 100 is disclosed and described in FIGS. 1-5. As seen with reference to FIG. 1, the vent cover 100 of the current embodiment includes a body 110 having an inner portion 120 and an outer portion 130. In the current embodiment, the inner portion 120 and the outer portion 130 are separate panels, although in alternate embodiments the inner portion 120 and the outer portion 130 may be included in a single panel or multiple panels. In the current embodiment, the inner portion 120 and the outer portion 130 are fastened together with fasteners in the form of four screws 105*a,b,c,d* (c,d shown in FIG. 2) extending through inner screw holes 125*a,b,c,d* (not shown) defined in the inner portion 120 into outer screw holes 135*a,b,c,d* (shown in FIG. 9) defined in the outer portion 130, respectively. Various types of fasteners may be used in various embodiments, including countersunk or counterbore screws, clamps, adhesives, nuts and bolts, or welding, among others, and the disclosure of screws 105*a,b,c,d* should not be considered limiting. The body 110 also defines four installation holes 101*a,b,c,d* (d shown in FIG. 2) extending through the inner portion 120 and the outer portion 130 to facilitate installation of the vent cover 100 onto a building with screws, nails, or various other fasteners, although other methods of installation may be used in various embodiments, including mounting brackets, clamps, adhesives, or welding, among others, and the disclosure of installation holes 101*a,b,c,d* should not be considered limiting. The four installation holes 101*a,b,c,d* are further defined through an installation surface 103 on the inner portion 120.

Figure 4:
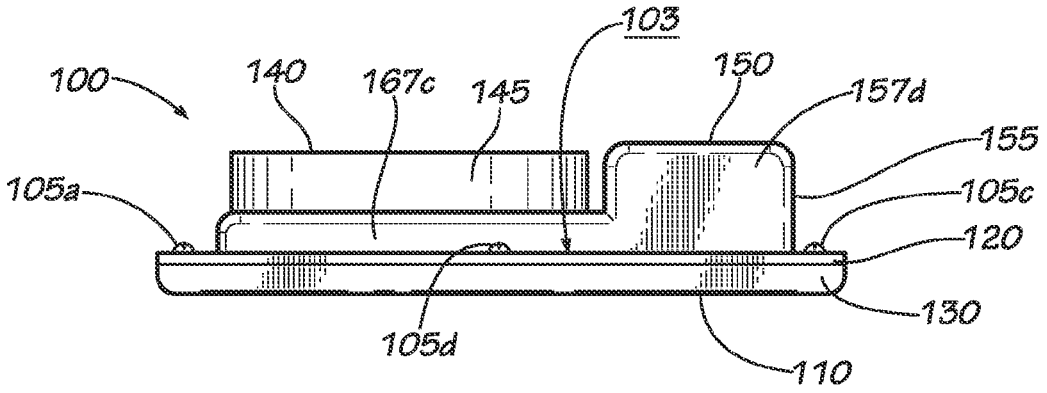
FIG. 4 is a side view of the vent cover of FIG. 1 with a door of the vent cover in a closed position.
Figure 5:
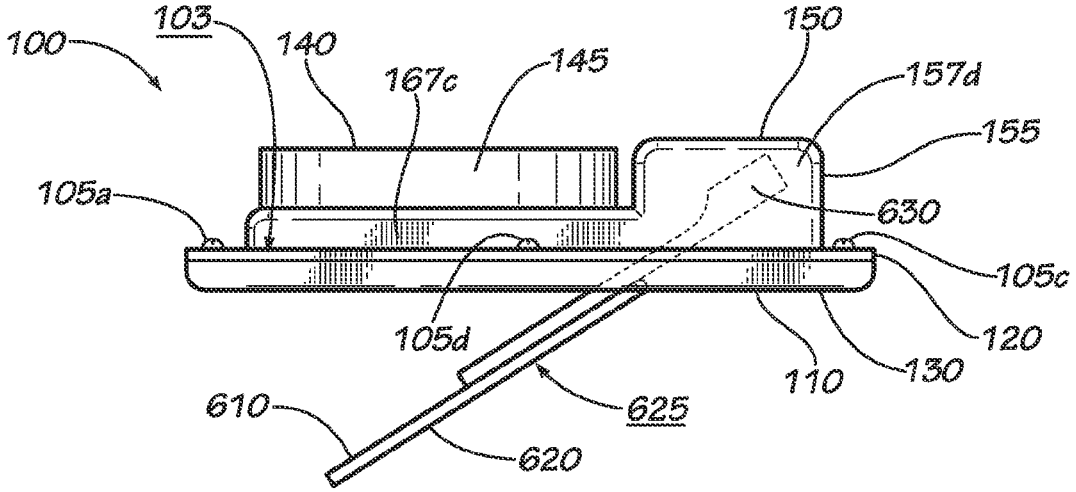
FIG. 5 is a side view of the vent cover of FIG. 1 with the door of the vent cover in an open position.

The body 110 also defines a vent exhaust hole 140 defined through the inner portion 120 and the outer portion 130. The vent exhaust hole 140 is adapted to accept one end of a vent duct 1220 (shown in FIG. 13). A wall 145 may further define the vent exhaust hole 140 and extend the vent exhaust hole 140 in an axial direction from the inner portion 120. It should be noted that, although the vent exhaust hole 140 is defined with a circular cross-section in the current embodiment, other cross-sectional profiles should be considered as included within the scope of the current disclosure. As can be seen in FIGS. 1, 4 and 5, the wall 145 has a height that is consistent and continuous around the vent exhaust hole 140 and is sized to accept vent duct 1220.

The body 110 also defines an enclosure 150 between the inner portion 120 and the outer portion 130. In the current embodiment, the enclosure 150 is defined within a raised portion 155 on the inner portion 120 and the outer portion 130, though other formations of the enclosure 150 are possible in other embodiments. The raised portion 155 includes side walls 157*a,b,c,d* (c,d not shown) and a top wall 159.

Figure 3:
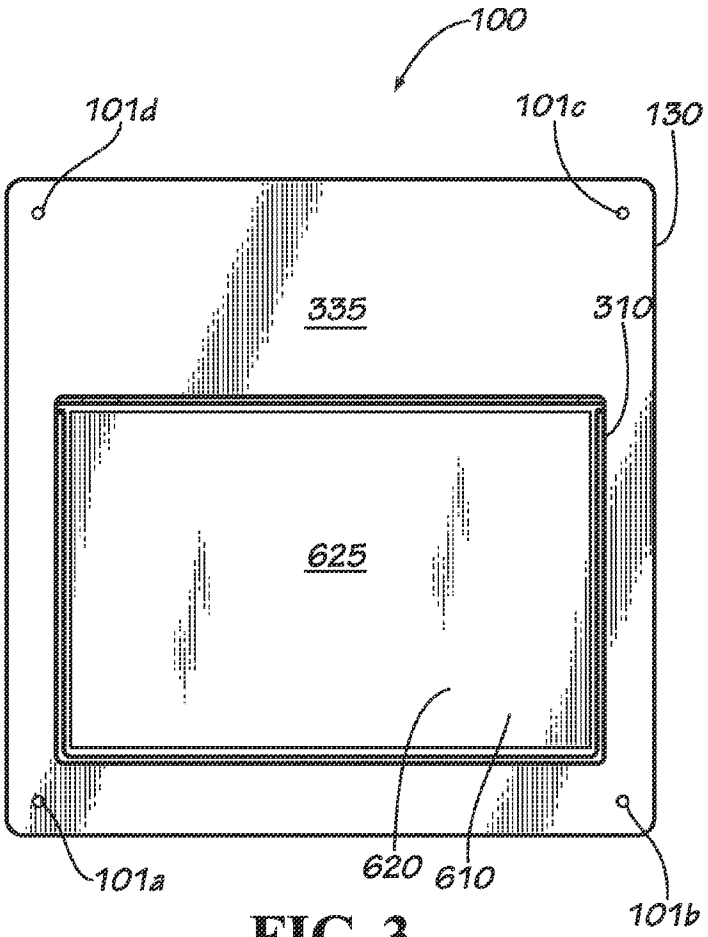
FIG. 3 is a bottom view of the vent cover of FIG. 1.
Figure 2:
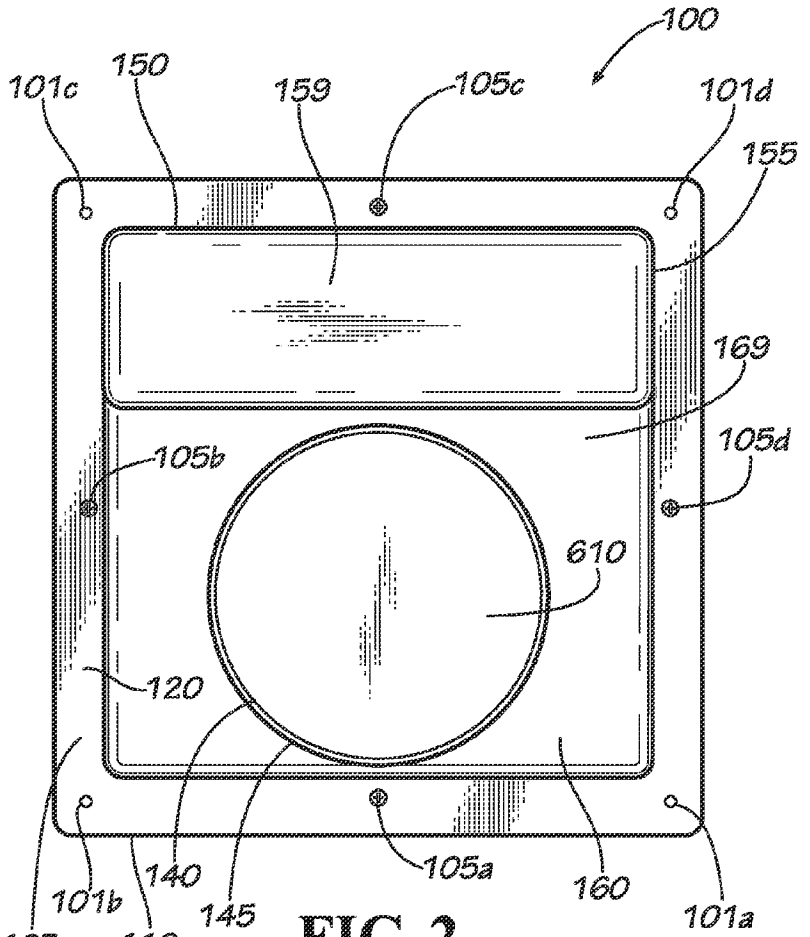
FIG. 2 is a top view of the vent cover of FIG. 1.

The vent cover 100 also includes a door 610. As can be seen in FIGS. 1, 2, and 3, the door 610 covers the vent exhaust hole 140 in a first position. In some embodiments, the first position is a closed position in which the door 610 fully covers the vent exhaust hole 140. In other embodiments the first position may by a partially closed position wherein the door 610 partially covers the vent exhaust hole 140. In some embodiments, the door 610 may seal the vent exhaust hole 140 when in the first position. In some embodiments, a sealer, such as a gasket or rubber fixture, may be included to ensure proper sealing. The door 610 includes a door portion 620 and a biasing portion 630 (shown in FIG. 6) in the current embodiment. In the current embodiment, the door portion 620 covers the vent exhaust hole 140 in the first position as shown in FIG. 4. As shown in FIG. 5, the door 610 may be arranged in a second position that is an open position where a clearance is provided between the door portion 620 and the vent exhaust hole 140 and the door 610 no longer covers the vent exhaust hole 140. In various embodiments, the door 610 may be arranged in third, fourth, or any number of positions with different clearances between the door portion 620 and the vent exhaust hole 140 to allow the door 610 to be open in a variety of positions. Although FIG. 5 shows a specific second position with the door 610 rotated relative to the first position, any second position may be used so long as the vent exhaust hole 140 is no longer covered by the door 610 to allow for venting through the vent exhaust hole 140.

In the current embodiment, inner portion 120 includes a recess 160 and the outer portion 130 includes a cut-out 310 (shown in FIG. 3). The recess 160 includes side walls 167*a,b,c* and a top wall 169. The recess 160 and the cut-out 310 are both sized to accept the door portion 620 when the door 610 is in the first position covering and sealing the vent exhaust hole 140, the cut-out 310 approximating the profile of the door portion 620. The current embodiment, the profile of the door portion 620 is rectangular, though other profiles may be used in other embodiments, such as a circular profile matching the circular cross-section of the vent exhaust hole 140. As can be seen in FIGS. 3, 4, and 5, the recess 160 and the raised portion 155 may border each other with the enclosure side walls 157*b,d* intersecting recess side walls 167*b,c*, respectively. In the current embodiment, the enclosure side wall 157*b* is coplanar with the recess side wall 167*b* and the enclosure side wall 157*d* is coplanar with the recess side wall 167*c*. In combination, the enclosure 150 and the recess 160 are sized to accept the door 610.

In the current embodiment, the outer portion 130 has an outer surface 335 and the door portion 620 has a door surface 625. The outer surface 335 and the door surface 625 may be designed to be impervious to the elements, such as with waterproof materials. When the door 610 is in the first position, the outer surface 335 and the door surface 625 are about coplanar, which helps the vent cover 100 blend visually with the exterior of the building that the vent cover 100 is installed on. This configuration also prevents interference with the vent cover 100 because no parts of the vent cover 100 extend from the exterior of the building when the door 610 is in the first position. Therefore the vent cover 100 is less likely to be damaged accidentally during work on the building such as window-cleaning, painting, and exterior renovations, and effectively prevents animals and debris from entering the building. It should be noted that, although the outer surface 335 and the door surface 625 are about coplanar in the current embodiment, the outer surface 335 and the door surface 625 may not be about coplanar in other embodiments, and any configuration of the outer surface 335 and the door surface 625 should be considered as included within the scope of the current disclosure.

Figure 7:
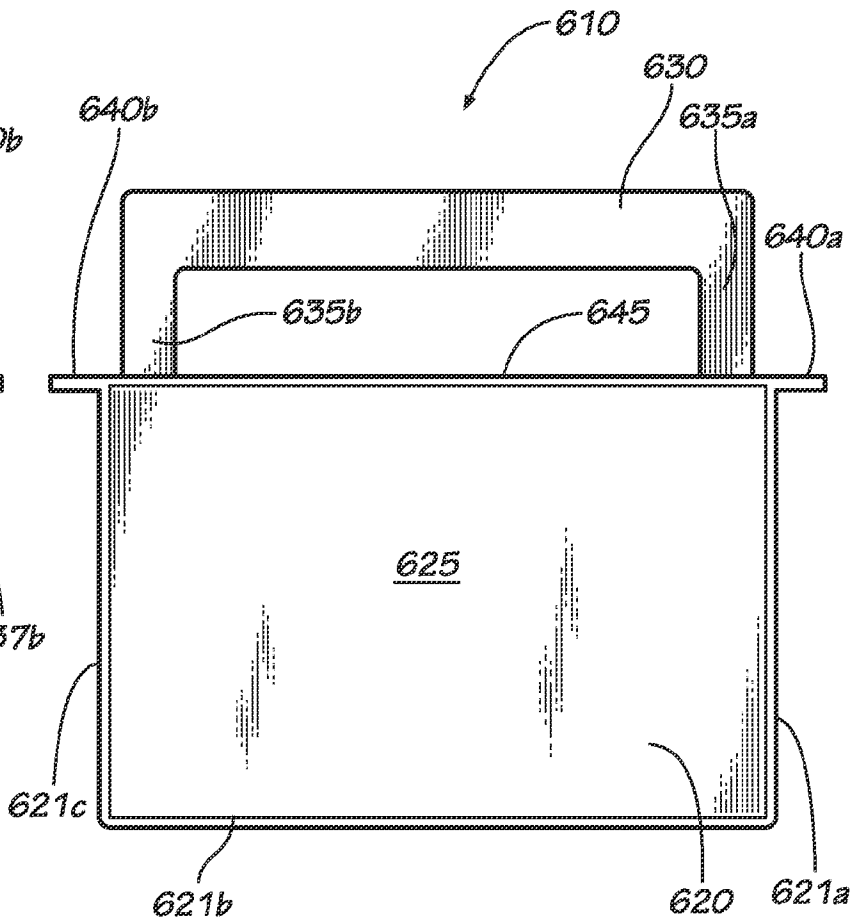
FIG. 7 is a bottom view of the door of the vent cover of FIG. 1.
Figure 6:
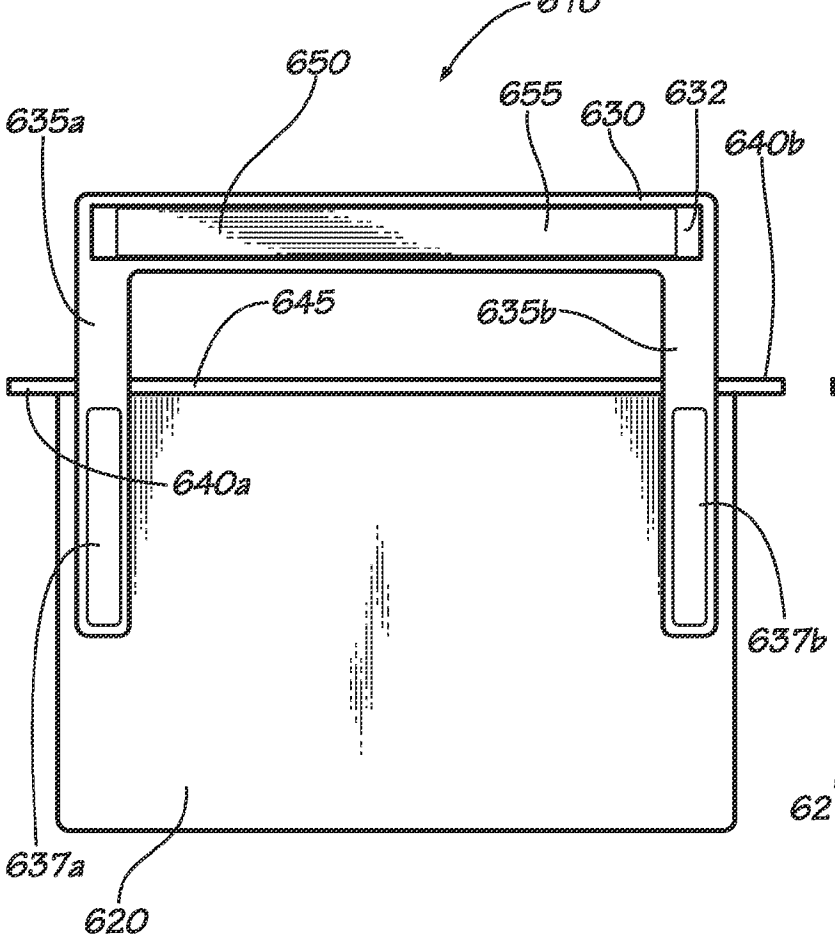
FIG. 6 is a top view of the door of the vent cover of FIG. 1.
Figure 8:
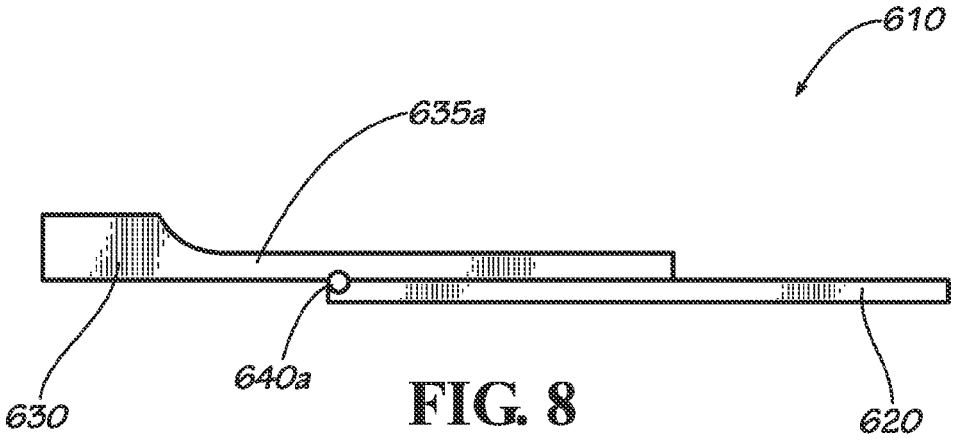
FIG. 8 is a side view of the door of the vent cover of FIG. 1.

FIGS. 6, 7, and 8 show the door 610. The door 610 includes hinge posts 640*a,b* extending from each side of the door portion 620 at corners proximate the biasing portion 630. Thus the hinge posts 640*a,b* operate as hinges for rotating the door 610 between the first position and the second position, although other mechanisms for rotating or moving the door 610 between the first position and the second position may be used, including a door hinge or springs, and the disclosure of hinge posts 640*a,b* should not be considered limiting. The hinge posts 640*a,b* and a hinge ridge 645 form a continuous ridge along one side of the door portion 620, as seen in FIG. 7, thereby positioning the biasing portion 630 and the door portion 620 on opposing sides of the hinge posts 640*a,b*. However, the biasing portion 630 and the door portion 620 may not be on opposing sides of the hinge posts 640*a,b* in other embodiments. As seen in FIG. 7, the door portion 620 also includes side ridges 621*a,b,c* along sides of the door portion 620. The hinge ridge 645 and the side ridges 621*a,b,c* form a continuous border around the door portion 620.

The biasing portion 630 includes a biasing element 650. In the current embodiment, the biasing element 650 is a weight 655 held within a weight channel 632. Various types of biasing elements may be used in various embodiments, including various types of springs (flat springs, helical springs, linear springs, etc.), magnets, electromagnets, and living hinges, among others, and the disclosure of the weight 655 should not be considered limiting. In the current embodiment, the weight 655 is positioned in a channel 660 of the biasing portion 630. Connecting the door portion 620 to the biasing portion 630 in the current embodiment are arms 635*a,b*, which may extend from the biasing element 650 past the hinge ridge 645 approximately halfway between the hinge ridge 645 and the side ridge 621*b*. In use, the weight 655 is offset from the hinge posts 640*a,b* at a distance by the arms 635*a,b* such that the downward force of gravity on the biasing portion 630 due to the weight 655 effects a torque about the hinge posts 640*a,b* that causes the door portion 620 to rotate into the recess 160 to cover the vent exhaust hole 140 and close the door 610, with the hinge posts 640*a,b* acting as a fulcrum.

In the current embodiment, the biasing element 650 is held within the enclosure 150. By placing the biasing element 650 within the enclosure 150, the biasing element 650 is protected from the elements and from tampering or accidental contact. Placing the biasing element 650 within the enclosure 150 also removes the biasing element 650 from the path of air flow through the vent exhaust hole 140, offsetting the biasing portion 630 from the door portion 620 so that only the door portion 620 is contacted by air flow.

The mass of the weight 655 and the biasing portion 630, as well as the length of the arms 635*a,b*, are calibrated so that the torque about the hinge posts 640*a,b* to close the door 610 is greater than the torque from the weight of the door portion 620 to open the door 610 and less than the torque to open the door 610 when the force of air flow through the vent exhaust hole 140 is applied to the door portion 620. The arms 635*a,b* may also include arm channels 637*a,b* to reduce the weight of the arms 635*a,b* proximate to the door portion 620. In the current embodiment, the weight 655 weighs and the arms 635*a,b* are calibrated to cause a torque to close the door 610 that is minimally greater than the torque to open the door 610 when there is no air flow through the vent exhaust hole 140. In such a situation, even a small amount of air flow will open the door 610. However, the weight 655, the length of the arms 635*a,b*, and the weight and size of the door portion 620 may all be calibrated to allow for the door 610 to remain in the first position for air flow less than a desired amount, and an air flow only greater than the desired amount may open the door. In addition, if the biasing element 650 is not the weight 655, the biasing element 650 may also be calibrated to allow the door 610 to open only when a desired amount of air flow through the vent exhaust hole 140 is achieved.

As can be seen in FIG. 8, when the door surface 625 faces in a downward direction, the arms 635*a,b* and the biasing portion 630 are vertically higher than the door portion 620 so that the arms 635*a,b* and the biasing portion 630 may be located between the inner portion 120 and the outer portion 130. By placing the arms 635*a,b* and the biasing portion 630 higher than the door portion 620, the biasing portion 630 may be located inside the enclosure 150 while the door surface 625 and the outer surface 335 are coplanar in the first position.

Figure 9:
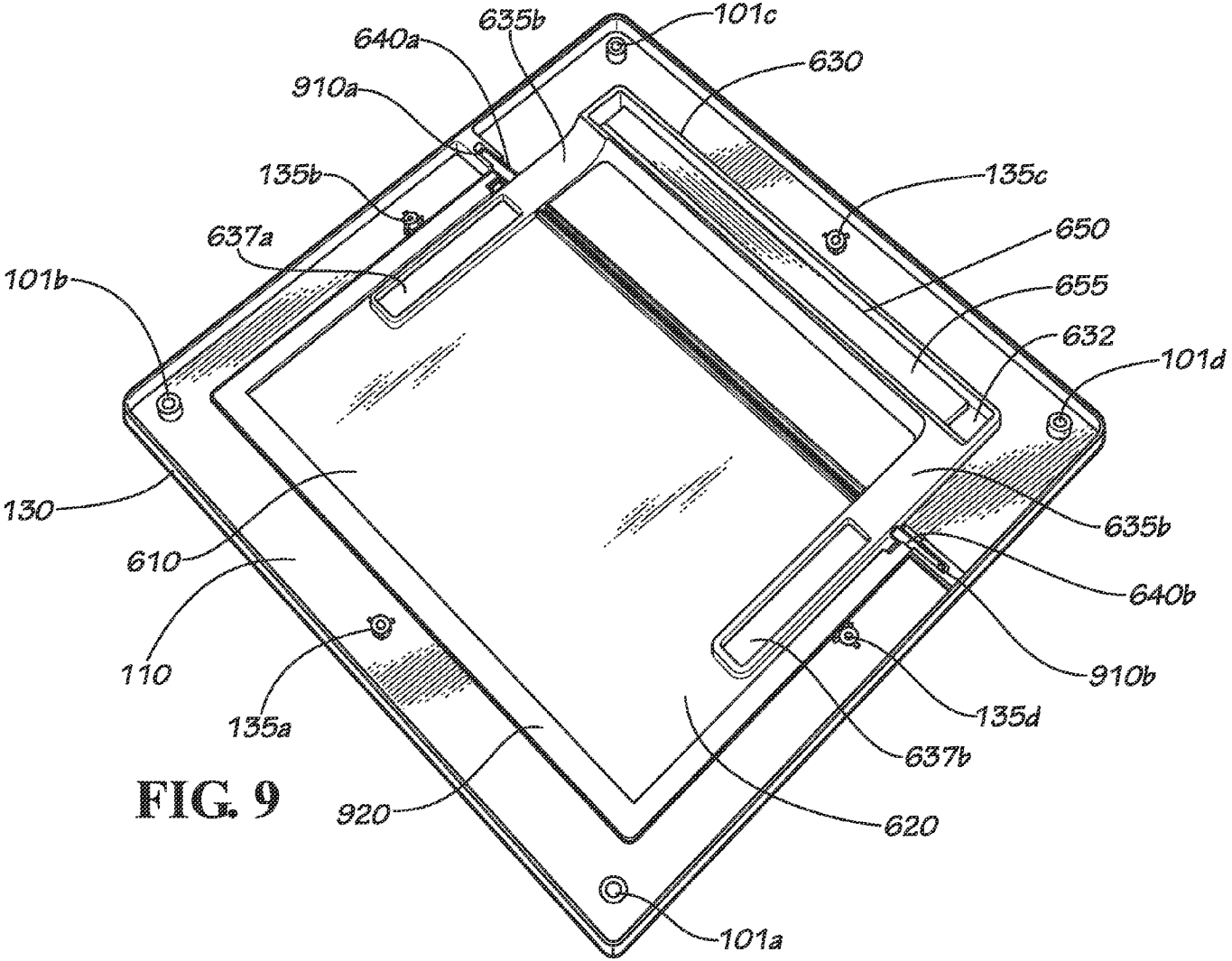
FIG. 9 is a perspective view of the vent cover of FIG. 1 with a top plate removed.

FIG. 9 shows a perspective view of the vent cover 100 with the inner portion 120 removed. The outer screw holes 135*a, b,c,d* can be seen in this view. As can be seen in FIG. 9, the outer portion 130 also includes hinge post grooves 910*a,b*. The hinge post grooves 910*a,b* are sized to accept the hinge posts 640*a,b* such that the hinge posts 640*a,b* may be snapped into and seat within the hinge post grooves 910*a,b* so that the hinge posts 640*a,b* are held in place such that the hinge posts 640*a,b* may rotate to allow the door 610 to open and close but are prevented from translational movement.

The outer portion 130 also includes a door lip 920, which acts as a stop for the door portion 620 when the door portion 620 is in the first position. When the inner portion 120 and the outer portion 130 are coupled to one another, the door lip 920 is located within the recess 160. It will be understand by one of skill in the art that the door lip 920 is optional and the inner portion 120 may alternatively act as a stop for the door portion 620 in the absence of the door lip 920.

Figure 10:
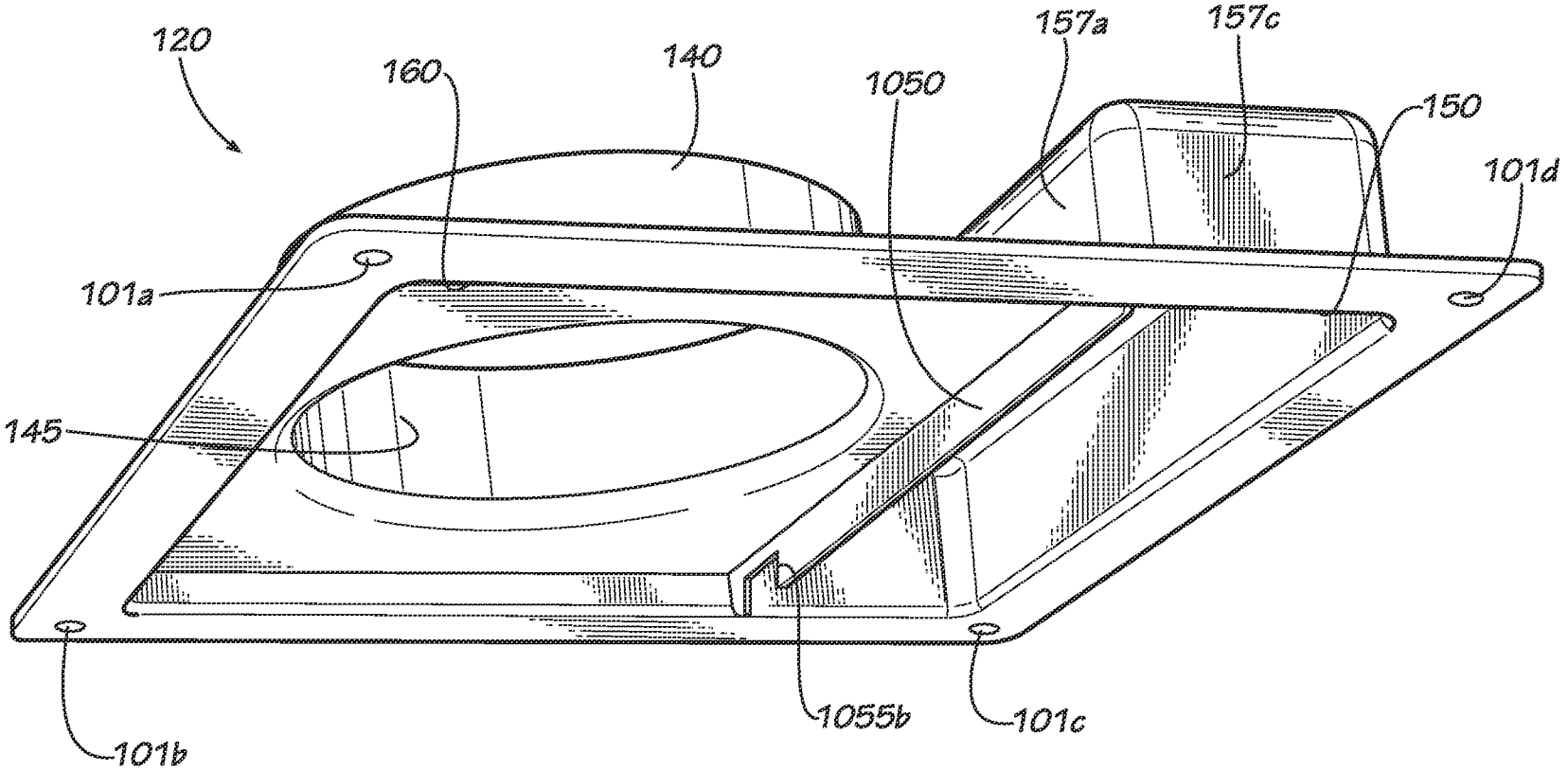
FIG. 10 is a perspective view of the top plate of the vent cover of FIG. 1.

FIG. 10 shows a perspective view of the inner portion 120. A separation baffle 1050 is formed on the inner portion 120 between the enclosure 150 and the recess 160. In some embodiments, the separation baffle 1050 may be formed on the outer portion 130 or may be independent of both the inner portion 120 and the outer portion 130. The separation baffle 1050 includes notches 1055*a,b* (1005*b* not shown). The arms 635*a,b* to extend through the notches 1055*a,b*. The notches 1055*a,b* are sized to allow rotation of the door 610 about hinge posts 640*a,b*. The separation baffle 1050 may function as a boundary between the enclosure 150 and air flow through the vent exhaust hole 140 and recess 160, reducing air turbulence and the accumulation of dust and debris inside the enclosure 150.

Figure 11:
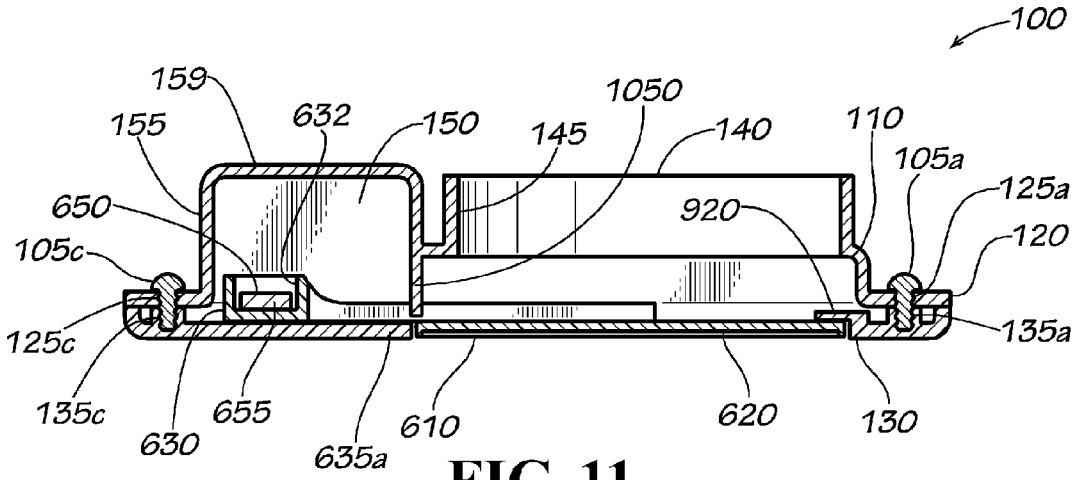
FIG. 11 is a side cross-sectional view of the vent cover of FIG. 1 with the door of the vent cover in the closed position.
Figure 12:
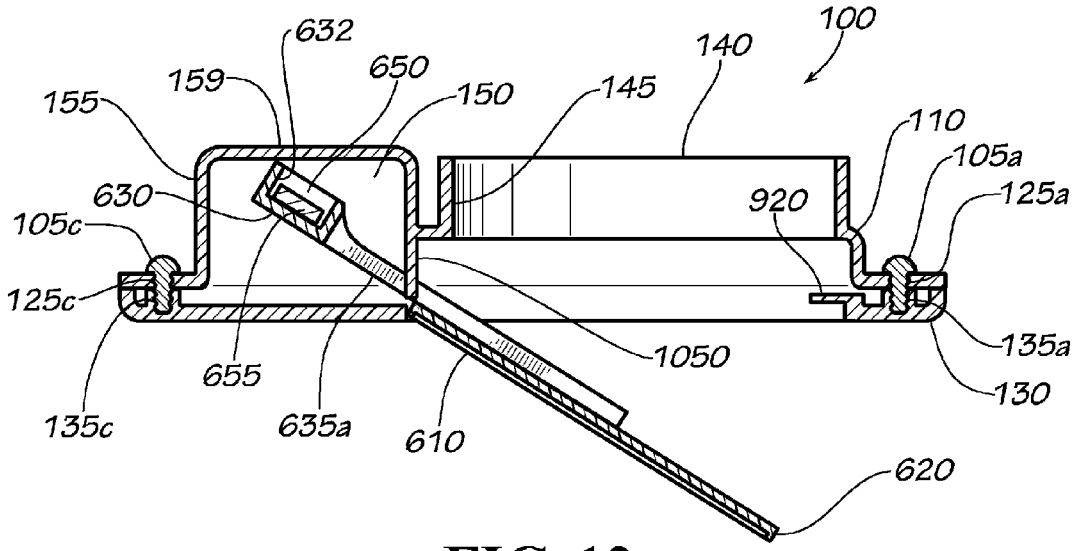
FIG. 12 is a side cross-sectional view of the vent cover of FIG. 1 with the door of the vent cover in the open position.

FIGS. 11 and 12 show a cross-sectional view of the vent cover 100 in the first (closed) and second (open) position, respectively. As can be seen in FIGS. 11 and 12, the enclosure 150 is sized to allow rotation of the door 610 between the first position and the second position. The biasing portion 630 and the arms 635*a,b* can be seen within the enclosure 150 in both the first and second positions. In the first position, the outer portion 130 may contact the biasing portion 630 or the arms 635*a,b*. In some embodiments, the outer portion 130 may act as a stop for the door portion 620 instead of the door lip 920 or the inner portion 120. In the second position, the biasing portion 630 contacts the top wall 159 of the enclosure 150, which may act as a stop to prevent further rotation of the door 610. In some embodiments, the notches 1055*a,b* of the separation baffle 1050 may act as a stop for the door portion 620 to prevent further rotation of the door 610 instead of top wall 159.

Figure 13:
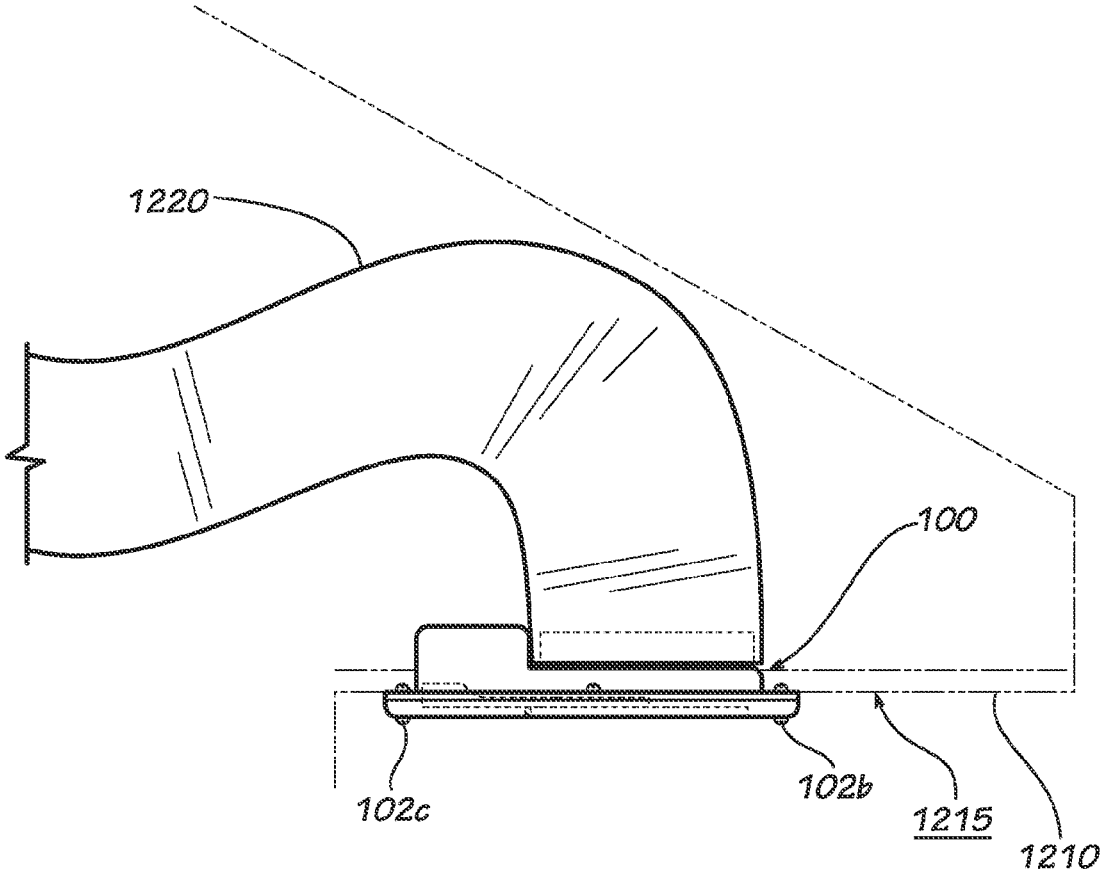
FIG. 13 is a view of the vent cover of FIG. 1 installed in a soffitt with the door of the vent cover in the closed position.
Figure 14:
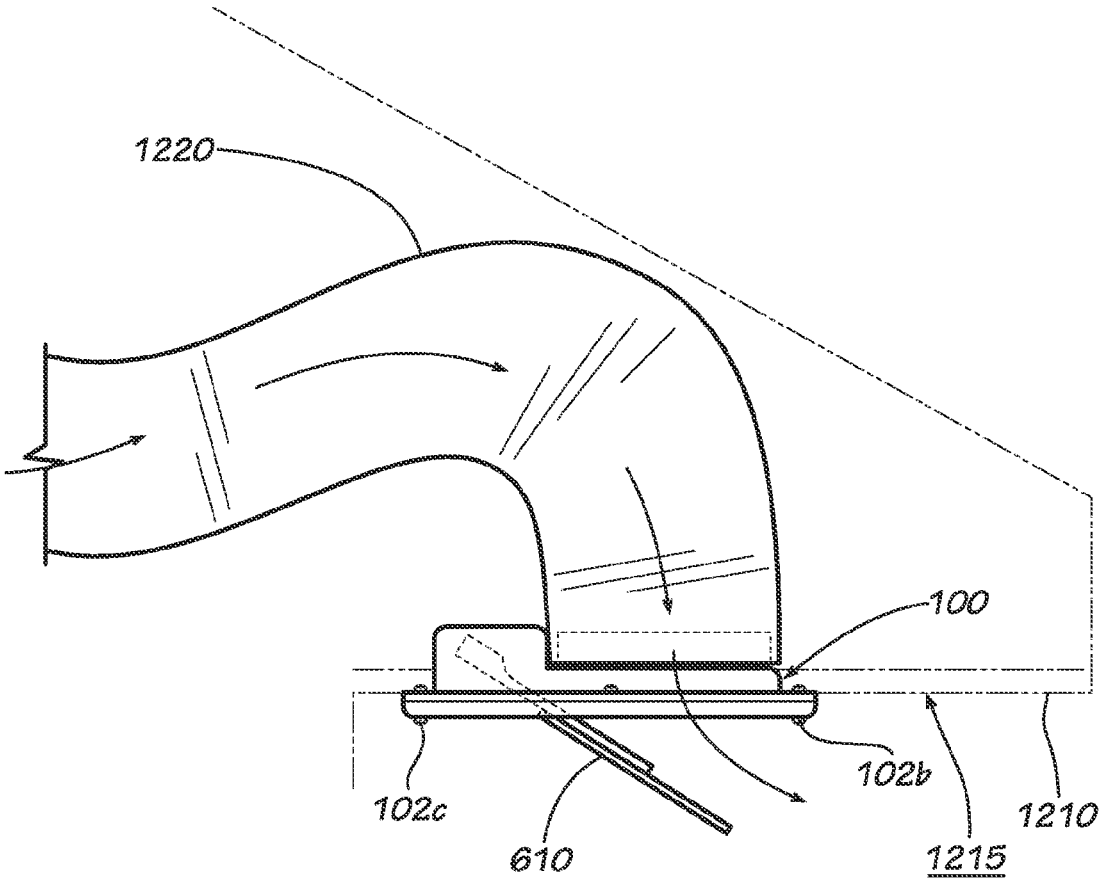
FIG. 14 is a view of the vent cover of FIG. 1 installed in the soffitt with the door of the vent cover in the open position.

FIGS. 13 and 14 show the vent cover 100 installed on the exterior of a building 1200. In the current embodiment, the vent cover 100 is installed in a soffit 1210 of the building 1200 with the door surface 625 facing downward, although this orientation should not be considered limiting. The installation surface 103 may contact a soffit surface 1215. To allow contact between the installation surface 103 and the soffit surface 1215, a cut-out may be made in the soffit surface 1215 that is sized to accept the raised portion 155 and the recess 160. When the installation surface 103 and the soffit surface 1215 are in contact, the vent cover 100 may be fastened to the soffit 1210 by, for example, inserting screws 102*a,b,c,d* (a,d not shown) through the four installation holes 101*a,b,c,d* and screwing them into the soffit 1210. In some embodiments, the cut-out may be sized to accept the entire vent cover 100 and the screws 102,*a,b,c,d* may be screwed directly through the four installation holes 101*a,b,c,d* into lookout rafters of the soffit 1210. The vent duct 1220 can be seen coupled to the vent exhaust hole 140. In some embodiments, the vent duct 1220 may be fastened to the vent exhaust hole 140 by a duct fastener. In the current embodiment, the vent duct 1220 may be connected to a venting unit 1250 (not shown), such as an exhaust fan for a bathroom, cooking apparatus, a clothes dryer, an air conditioning unit, or a fireplace, or any other venting apparatus. The vent cover 100 may be used to vent any form of exhaust, such as waste heat from industrial processes, water vapor, non-toxic gases, fumes from fume hoods in research labs, engine exhaust, smoke in commercial kitchens in restaurants, or any other commercial, industrial, or residential use where exhaust must be vented from a building. The vent cover 100, vent duct 1220, and venting unit 1250 form an exhaust system. In some embodiments, the venting unit 1250 may be directly connected to the vent cover 100 without the vent duct 1220. When the venting unit 1250 is off, as shown in FIG. 13, there is no air flow in the vent duct 1220. When there is no air flow in the vent duct 1220, the door 610 remains in the first position due to the biasing effect of the biasing element 650, which forces the door 610 into the first position. As described previously, the biasing effect in the current embodiment is from the force of gravity acting on the weight 655.

When the venting unit 1250 is turned on or activated, as shown in FIG. 14, such as when a building occupant takes a shower, air flow enters the vent duct 1220 from the venting unit 1250. The force of the air flow through the vent duct 1220 towards the vent exhaust hole 140 pushes against the door portion 620, acting as the biasing effect of the biasing element 650. In the current embodiment, the biasing effect of the weight 655 is overcome by the force of the air flow through the vent duct 1220, pushing the door 610 into the second position to allow the release of air from the interior of the building 1200. In the current embodiment, the weight 655 provides efficiency because the door 610 may remain in the open position without an increase in air pressure beyond the air pressure required to push the door 610 into the open position. So long as the venting unit 1250 remains turned on, the air flow will apply force to the door portion 620 and hold the door 610 in the second position. When the air flow ceases upon turning off the venting unit 1250, the door 610 will return back to the first position due to the biasing effect of the biasing element 650, closing and sealing the vent exhaust hole 140. In the current embodiment, the door portion 620 moves upwards towards the vent exhaust hole 140 when the air flow ceases.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and subcombinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A vent cover comprising:

a body having an inner portion including an installation surface and an outer portion, a recess extending outwardly from the installation surface opposite the outer portion, a vent exhaust hole defined in the body through the inner portion and the outer portion, and an enclosure defined between the inner portion and the outer portion; and a door movably coupled to the body, the door including a biasing portion and a door portion, the door moveable between a first position and a second position, the door in the first position at least partially covering the vent exhaust hole, the second position having a clearance between the door portion and the vent exhaust hole, the biasing portion enclosed within the enclosure of the body and including a biasing element biasing the door to the first position, the door includes at least one hinge post; and the enclosure is further defined within a raised portion on the recess, wherein the enclosure and the vent exhaust hole are on opposite sides of the at least one hinge post, the enclosure having a length at least as long as the biasing element, the biasing element contacting the inner portion in the second portion.

2. The vent cover of claim 1, wherein the door in the first position fully covers the vent exhaust hole.

3. The vent cover of claim 1, wherein the biasing element is a weight.

4. The vent cover of claim 1, wherein the body includes a separation baffle between the vent exhaust hole and the enclosure.

5. The vent cover of claim 1, wherein the door portion and the outer portion define an about flat surface when the door is in the first position and wherein the recess accepts the door portion.

6. The vent cover of claim 1, wherein the outer portion defines a cut-out approximating a profile of the door portion.

7. The vent cover of claim 1, wherein at least one groove defined in the body accepts the at least one hinge post, and wherein the biasing portion and the door portion are included on opposing sides of the at least one hinge post.

8. The vent cover of claim 7, wherein the at least one hinge post is two hinge posts and the at least one groove is two grooves.

9. The vent cover of claim 1, wherein the biasing portion and the door portion are included on opposing sides of the at least one hinge post.

10. A method for venting a building comprising:

activating an exhaust system;

venting exhaust through the exhaust system to a vent cover on the exterior of the building, the vent cover having a body with an inner portion including an installation surface and an outer portion, a recess extending outwardly from the installation surface opposite the outer portion, a vent exhaust hole defined in the body through the inner portion and the outer portion, an enclosure defined between the inner portion and the outer portion, and a door movably coupled to the body, the door including a biasing portion and a door portion, the biasing portion enclosed within the enclosure of the body and including a biasing element biasing the door towards a first position at least partially covering the vent exhaust hole; and venting the exhaust through the vent exhaust hole, the door moving towards a second position having a clearance between the door portion and the vent exhaust hole and the biasing element contacts the inner portion; and the enclosure is further defined within a raised portion on the recess.

11. The method of claim 10, further comprising ceasing venting the exhaust, the door moving back to the first position.

12. The method of claim 10, wherein the biasing element is a weight.

13. The method of claim 12, wherein biasing the door towards the first position includes the weight moving the biasing element downward to move the door portion upwards towards the vent exhaust hole.

14. The method of claim 10, wherein the biasing portion contacts the inner portion in the second position.

15. The method of claim 10, wherein venting the exhaust through the vent exhaust hole applies force to the door portion to move the door towards the second position.

16. The method of claim 10, wherein moving the door towards the second position involves rotating the door on at least two hinge posts seated within two hinge post grooves defined in the body.

17. The method of claim 10, wherein the body includes a separation baffle between the vent exhaust hole and the enclosure.

* * * * *